US008610379B1

(12) United States Patent
Grisham

(10) Patent No.: US 8,610,379 B1
(45) Date of Patent: Dec. 17, 2013

(54) SYSTEMS AND METHODS FOR THE MAGNETIC INSULATION OF ACCELERATOR ELECTRODES IN ELECTROSTATIC ACCELERATORS

(75) Inventor: Larry R. Grisham, Princeton, NJ (US)

(73) Assignee: U.S. Department of Energy, Washington, DC (US)

( * ) Notice: Subject to any disclaimer, the term of this patent is extended or adjusted under 35 U.S.C. 154(b) by 728 days.

(21) Appl. No.: 12/640,058

(22) Filed: Dec. 17, 2009

(51) Int. Cl.
*H05H 9/00* (2006.01)

(52) U.S. Cl.
USPC ..... 315/505; 315/111.61

(58) Field of Classification Search
USPC ..... 315/39, 39.51, 39.63, 39.71, 500–507, 315/111.01–111.91
See application file for complete search history.

(56) References Cited

U.S. PATENT DOCUMENTS 4,879,518 A * 11/1989 Broadhurst ..... 315/506
5,391,962 A * 2/1995 Roberts et al. ..... 313/362.1

* cited by examiner

*Primary Examiner* — Jimmy Vu
(74) *Attorney, Agent, or Firm* — Jacob Heafner; Brian J. Lally; John T. Lucas

(57) ABSTRACT

The present invention provides systems and methods for the magnetic insulation of accelerator electrodes in electrostatic accelerators. Advantageously, the systems and methods of the present invention improve the practically obtainable performance of these electrostatic accelerators by addressing, among other things, voltage holding problems and conditioning issues. These problems and issues are addressed by flowing electric currents along these accelerator electrodes to produce magnetic fields that envelope the accelerator electrodes and their support structures, so as to prevent very low energy electrons from leaving the surfaces of the accelerator electrodes and subsequently picking up energy from the surrounding electric field. In various applications, this magnetic insulation must only produce modest gains in voltage holding capability to represent a significant achievement.

6 Claims, 3 Drawing Sheets

SYSTEMS AND METHODS FOR THE MAGNETIC INSULATION OF ACCELERATOR ELECTRODES IN ELECTROSTATIC ACCELERATORS

CONTRACTUAL ORIGIN OF THE INVENTION

The U.S. Government has certain rights in the present invention pursuant to Contract No. DE-AC02-08CH11555 between the Department of Energy (DOE) and the Princeton Plasma Physics Laboratory (PPPL).

FIELD OF THE INVENTION

The present invention relates generally to systems and methods for the magnetic insulation of accelerator electrodes in electrostatic accelerators. Advantageously, the systems and methods of the present invention improve the practically obtainable performance of these electrostatic accelerators by addressing, among other things, voltage holding problems and conditioning issues. These problems and issues are addressed by flowing electric currents along these accelerator electrodes to produce magnetic fields that envelope the accelerator electrodes and their support structures, so as to prevent very low energy electrons from leaving the surfaces of the accelerator electrodes and subsequently picking up energy from the surrounding electric field. In various applications, this magnetic insulation must only produce modest gains in voltage holding capability to represent a significant achievement.

BACKGROUND OF THE INVENTION

The injection of energetic beams composed of neutral hydrogen isotope atoms has for generations been a staple means of heating and driving currents in plasmas in magnetically confined fusion devices. These energetic beams are formed by electrostatically accelerating high currents (on the order of tens of amperes) of either positive or negative ions extracted from a large area plasma source (on the order thousands of square centimeters). The ion beam traverses a neutralizer (i.e. a gas cell in the systems built to date), where a portion of the ions are converted to neutral atoms. The residual ions are magnetically or electrically deflected, while the remaining neutral beam crosses the stray magnetic field of the fusion device to enter the confined plasma, where the atoms are ionized and spiral along the magnetic field, transferring energy and momentum to the bulk plasma through collisions.

One of the primary challenges encountered by these neutral beam systems is holding large voltage gradients across the gaps between the grids and support structures that make up the electrostatic accelerator. Earlier generations of beam systems, accelerating positive ions to 30-140 keV, typically had one or two acceleration gaps, while the higher energies used in negative ion systems required for larger fusion devices typically have several acceleration gaps. Vacuum breakdown between grids at different potentials, and also between their support structures inside the vacuum, limits the potential gradients that may be sustained in such electrostatic accelerators, and requires large amounts of time to be devoted to conditioning the electrostatic accelerators.

Conditioning is a procedure in which the applied voltage is raised in small increments, pausing whenever a breakdown is encountered, in order to allow the energy associated with subsequent breakdowns by micromachining the voltage holding surfaces until they are capable of sustaining such voltages, before moving up in voltage slightly and repeating the process. For the conditioning process to work, the fault energy and maximum current need to be large enough to smooth microprojections that concentrate the electric field, but not so large as to pit the electrode surface and create more emitting points. This process is typically done first without extracting an ion beam, and, then, much more slowly with beam extraction.

In neutral beam systems operated over the past four decades, the beam pulses have had maximum durations of fractions of seconds to tens of seconds, and low duty factors. Conditioning such electrostatic accelerators close to their full design voltage has typically taken many days to some months of operation. The most ambitious operational neutral beam systems, designed to operate at 500 keV, have never accelerated a beam at more than about 410 keV, and almost all of their operations have been at 370 keV or lower, partly because of voltage holding problems and partly because of ion source problems. Negative ion neutral beam systems being developed are supposed to operate at energies of 1 MeV for pulse lengths of up to 1000 seconds with high reliability and infrequent maintenance. Achieving such performance requires that every opportunity to improve the operability of high current large area electrostatic accelerators is explored.

BRIEF SUMMARY OF THE INVENTION

In various exemplary embodiments, the present invention provides systems and methods for the magnetic insulation of accelerator electrodes in electrostatic accelerators. Advantageously, the systems and methods of the present invention improve the practically obtainable performance of these electrostatic accelerators by addressing, among other things, voltage holding problems and conditioning issues. These problems and issues are addressed by flowing electric currents along these accelerator electrodes and their support structures to produce magnetic fields that envelope the accelerator electrodes and their support structures, so as to prevent very low energy electrons from leaving the surfaces of the accelerator electrodes and subsequently picking up energy from the surrounding electric field. In various applications, this magnetic insulation must only produce modest gains in voltage holding capability to represent a significant achievement. Magnetic insulation may be used to improve the performance of many devices using electric fields to accelerate ions, charged clumps of atoms, charged droplets, charged powders, etc.

In one exemplary embodiment, the present invention provides a system for accelerating charged entities, including: a charged entity source; one or more accelerator electrodes for accelerating charged entities provided by the charged entity source; and one or more power supplies coupled to the one or more accelerator electrodes for providing an electrical current through each of the one or more accelerator electrodes and generating a magnetic field around each of the one or more accelerator electrodes. The system also includes one or more support structures connected to the one or more accelerator electrodes, wherein the one or more power supplies are also coupled to the one or more support structures for providing an electrical current through each of the one or more support structures and generating a magnetic field around each of the one or more support structures. Optionally, a direction of the current provided through each of the one or more accelerator electrodes and support structures is reversed for alternating accelerator electrodes and support structures. Preferably, the magnetic field is substantially parallel to a surface of each of the one or more accelerator electrodes and support structures. The magnetic field prevents charged entities from leaving a surface of each of the one of more accelerator electrodes and support structures and picking up energy from a surrounding electric field. In general, the one or more power supplies, electrical currents, and magnetic fields are used to improve the voltage holding capability of the system.

In another exemplary embodiment, the present invention provides a method for accelerating charged entities, including: providing a charged entity source; providing one or more accelerator electrodes for accelerating charged entities provided by the charged entity source; and providing one or more power supplies coupled to the one or more accelerator electrodes for providing an electrical current through each of the one or more accelerator electrodes and generating a magnetic field around each of the one or more accelerator electrodes. The method also includes providing one or more support structures connected to the one or more accelerator electrodes, wherein the one or more power supplies are also coupled to the one or more support structures for providing an electrical current through each of the one or more support structures and generating a magnetic field around each of the one or more support structures. Optionally, a direction of the current provided through each of the one or more accelerator electrodes and support structures is reversed for alternating accelerator electrodes and support structures. Preferably, the magnetic field is substantially parallel to a surface of each of the one or more accelerator electrodes and support structures. The magnetic field prevents charged entities from leaving a surface of each of the one of more accelerator electrodes and support structures and picking up energy from a surrounding electric field. In general, the one or more power supplies, electrical currents, and magnetic fields are used to improve the voltage holding capability of a system.

In a further exemplary embodiment, the present invention provides a method for magnetically insulating a system for accelerating charged entities using one or more accelerator electrodes, including: providing an electrical current through each of the one or more accelerator electrodes, thereby generating a magnetic field around each of the one or more accelerator electrodes. The method also includes providing an electrical current through each of one or more support structures associated with the one or more accelerator electrodes and generating a magnetic field around each of the one or more support structures. Optionally, a direction of the current provided through each of the one or more accelerator electrodes and support structures is reversed for alternating accelerator electrodes and support structures. Preferably, the magnetic field is substantially parallel to a surface of each of the one or more accelerator electrodes and support structures. The magnetic field prevents charged entities from leaving a surface of each of the one of more accelerator electrodes and support structures and picking up energy from a surrounding electric field.

BRIEF DESCRIPTION OF THE DRAWINGS

The present invention is illustrated and described herein with reference to the various drawings, in which like reference numbers are used to denote like system components/method steps, as appropriate, and in which.

DETAILED DESCRIPTION OF THE INVENTION

Again, in various exemplary embodiments, the present invention provides systems and methods for the magnetic insulation of accelerator electrodes in electrostatic accelerators. Advantageously, the systems and methods of the present invention improve the practically obtainable performance of these electrostatic accelerators by addressing, among other things, voltage holding problems and conditioning issues. These problems and issues are addressed by flowing electric currents along these accelerator electrodes to produce magnetic fields that envelope the accelerator electrodes and their support structures, so as to prevent very low energy electrons from leaving the surfaces of the accelerator electrodes and subsequently picking up energy from the surrounding electric field. In various applications, this magnetic insulation must only produce modest gains in voltage holding capability to represent a significant achievement.

Magnetic insulation may be used to improve the voltage holding and performance of the ion beam accelerator systems used for magnetic fusion devices, among other devices. It may be used in all devices that use electric fields to accelerate ions or other charged entities, such as clusters of atoms, droplets, or powders. Such devices have many applications, ranging from electrostatic accelerators for research to industrial applications, such as materials alteration through surface treatments with ion beams, ion implanters in the semiconductor industry, paint, powder, and general liquid sprayers, and many others. Magnetic insulation allows such systems to operate with higher absolute voltage gradients, increased flow throughputs, improved reliability, and, in some applications, reduced absolute voltages across shorter acceleration gaps permitted by the higher absolute voltage gradients obtainable with magnetic insulation.

Figure 1:
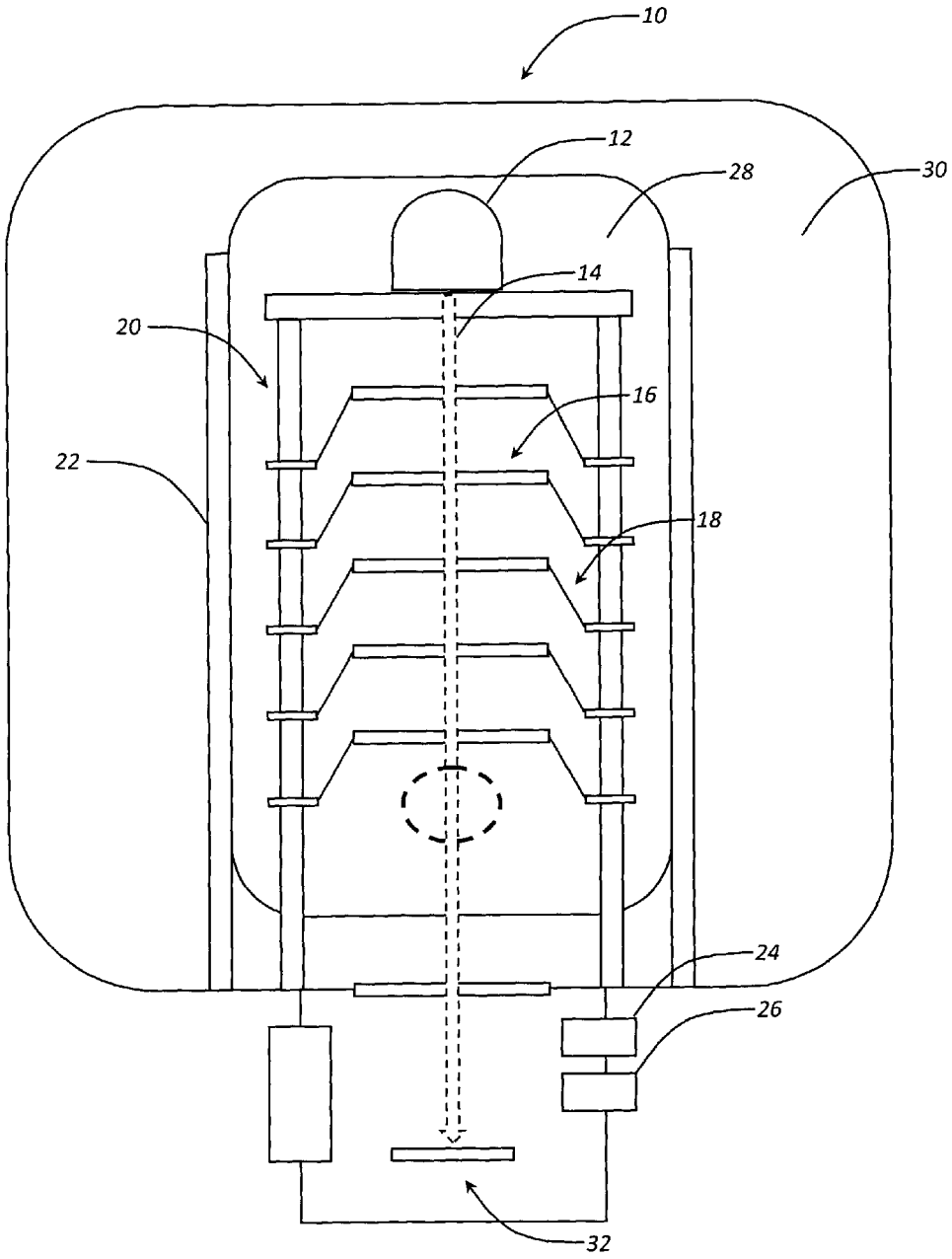
FIG. 1 is a schematic diagram illustrating, generally, a typical electrostatic accelerator including a plurality of accelerator electrodes and associated support structures with which the magnetic insulation systems and methods of the present invention may be utilized.

Referring to FIG. 1, in one exemplary embodiment, a typical electrostatic accelerator 10 for either positive or negative ions includes an ion source 12 that, in conjunction with an extractor (not illustrated), is operable for generating a beam of ions 14 and directing the beam 14 to and through a plurality of flat grid plates 16, each of which has a graduated electrical potential that serves to accelerate the beam 14 in a step-wise manner. In this respect, each of the plurality of flat grid plates 16 represents an accelerator electrode. Each of the plurality of flat grid plates 16 includes one or more apertures (not illustrated) that separate the beam 14 into one or more beamlets. Each of the plurality of flat grid plates 16 is connected to a supporting structure 18 that has the same electrical potential as the corresponding flat grid plate 16. Optionally, one of the plurality of flat grid plates 16 is grounded. It will be readily apparent to those of ordinary skill in the art that a wide variety of electrostatic accelerators may be utilized in conjunction with the magnetic insulation systems and methods of the present invention. These electrostatic accelerators may include various other components and devices, not necessarily germane to the present invention, including, but not limited to, various stress rings (not illustrated), various insulators 20 and 22, various beam shields (not illustrated), various flanges (not illustrated), various cameras 24 and 26, various other sensing devices (not illustrated), various circuits (not illustrated), various housings 28, various pressure vessels 30 for containing various gasses, various shields (not illustrated), a target 32, etc.

One avenue through which it is possible to improve voltage holding within vacuum-insulated electrostatic accelerators is to improve the insulating strength of the vacuum through the imposition of enveloping magnetic fields parallel to the flat grid plates 16 (FIG. 1) and their support structures 18 (FIG. 1). The systems and methods of the present invention magnetically insulate accelerator electrodes 16 by flowing electrical current along each accelerator gird 16 and its associated support structure 18, so as to produce a magnetic field which envelopes each flat grid plates 16 and its support structure 18.

The salient characteristic of a magnetic field produced in this manner is that it is everywhere parallel to the surface of the flat grid plate 16 and the support structure 18 through which the electrical current is flowing. This is important because a magnetic field parallel to the surface increases the impedance of the vacuum surrounding it, whereas a magnetic field with a component that intersects the surface would decrease the vacuum impedance, and facilitate high voltage breakdown instead of impeding it. This requirement, that the magnetic field not intersect the conductor surface anywhere inside the vacuum, largely rules out any practical configuration of permanent magnets to produce the magnetic insulation.

Fortunately, the power supply requirements to produce a substantial electrical current flowing along a flat grid plate 16 and the conducting sheets which feed it are not daunting. While a typical accelerator flat grid plate 16 likely requires at least several kiloamperes of magnetic insulation current capability, the electrical resistance of each flat grid plate 16 and its support structure 18 is very low, a small fraction of an ohm, such that the voltage required from the high current power supply is low, and the additional power ohmically dissipated in the accelerator flat grid plate 16 and its support structure 18 is correspondingly low. Each accelerator stage requires one of these high current-low voltage power supplies floating at the accelerating potential of that stage. These supplies may be located in the high voltage deck feeding the accelerator. In order to keep the electrical impedance seen by each magnetic insulation power supply small, it is necessary to increase the cross section of the cable carrying the high voltage and the magnetic insulation current to each accelerator stage.

In the past, magnetic insulation has been proposed for gigavolt transformers and the like, but faced severe problems due to the very high gradients, fluctuating fields, and virtually perfect performance required. More recently, a magnetically insulated transformer concept that may be suitable for pulsed power transformer applications has been demonstrated at 100 kV. On the whole, magnetically insulating an electrostatic accelerator is a simpler undertaking, as the electrical current does not need to vary rapidly, or at all, other than to turn it on and off.

The most common and least disputed source of high voltage breakdown in vacuum is electron emission from sharp edges or microprojections on the surfaces of electrodes, where the electric field strength is strongly enhanced relative to the nominal field strength if the electrodes were perfect planes. Because the electrons are emitted from a very tiny point, the current density may become large enough to vaporize metal and produce a metal vapor arc, also with a high current density. This model of breakdown is generally thought to adequately describe the linear regime of voltage holding with distance between electrodes that holds for electrode spacings of up to about a centimeter, but it is thought to fail for larger gaps, where, beyond a centimeter, the voltage that a vacuum gap is capable of withstanding appears to scale as about the square root of the gap between the electrodes.

In an attempt to find a mechanism that might yield the apparent square root of gap scaling of the voltage that could be held across a larger vacuum gap, other explanations have at times been proposed, including clump theory, which suggests that clumps of material become charged and pick up sufficient energy in being accelerated across the gap to produce an ionized gas cloud when they strike the other electrode, triggering an arc, or the particle exchange model, which postulates negative and positive ions and electrons being accelerated across the gap to initiate a discharge. While these models may result in a scaling of maximum voltage holding with gap distance in a way similar to that observed, it is not clear whether they are entirely physically plausible. It is not apparent why detachable clumps would always be initially present on all vacuum surfaces, and why they would subside with conditioning, or how they would concentrate enough energy to vaporize and ionize material upon impact. The status of ion exchange theory seems even less clear, and in any event, some of the most common gases one might expect to find on surfaces in recently evacuated volumes would make few if any negative ions. Hydrogen has an electron affinity of only 0.75 eV, and produces almost no negative ions when reflected or desorbed from materials commonly used for accelerator grids unless the electron work function has been lowered by deposition of an alkali metal. Nitrogen has no electron affinity, and therefore produces no negative ions.

One reason that the electric field emission of electrons, the most physically plausible model for voltage holding in vacuum, does not entirely work in explaining voltage holding across all gap lengths might be that it does not entirely include the necessary physics. Insofar as may be ascertained, the simple treatment of voltage breakdown across vacuum gaps does not include the self-magnetic field of the electrons, either of the electrons emitted from high-field projections or edges, or of the electrons in the subsequent metal vapor arc. The magnetic field associated with the electric current produced by the electron flow produces a magnetic field encircling the current. This magnetic field, which in most cases likely has a roughly circular cross section, results in at least two effects that affect the evolution of high voltage breakdown and consequently affect how voltage holding scales with the distance between electrodes.

One effect of the self-magnetic field is to collimate and focus the electrons, changing what might otherwise be a dispersed spray into a high current density flow carrying much higher power density than would a dispersed spray. The second effect is to render this column of electrons kink unstable, which, as is known from basic plasma physics, is the case with all such current channels. These same two effects are what govern the dynamics of a closely related phenomenon, unipolar arcs, which arise across a sheath between an electrode and a plasma, leaving a characteristic dendritic, or "chicken track," pattern on the electrode as the tightly collimated electron beam wanders around on the surface under the influence of the kinks. The first of these effects, the collimating of the electron flow by the self-induced magnetic field, may be a contributing factor, or perhaps the primary factor, to why the voltage sustainable across larger gaps is less than linear with gap distance, so that large gaps sustain lower gradients than smaller gaps. The second effect, the kink instability driven by the self-magnetic field, is more likely to produce the opposite effect, rendering larger gaps able to sustain higher electric field gradients, because the kinking would both increase the path length and decrease the dwell time of the electron flow at any given spot on the anode. Since the observed scaling in the vacuum breakdown literature is that for gaps larger than a centimeter, the sustainable gradient decreases with electrode separation, it follows that the collimating and focusing effect of the self-magnetic field of the electron current must be more important than the effects of the kink instability it drives, if the self magnetic field is, as is suggested, important in determining voltage holding characteristics.

Regardless of which of these effects, or which mixture of these effects, dominates in producing spontaneous breakdown across vacuum gaps between electrodes, magnetic insulation which envelopes the accelerator electrodes as suggested by the present invention impedes the breakdown process by keeping the initial charged particles very close to the accelerator electrode surface. If the motion is restricted sufficiently so that the charged particles do not fall across enough of the potential gradient to pick up enough kinetic energy to enlarge their Larmor radii sufficiently to allow them to move beyond the surface imperfections that could intercept them, or if the magnetic insulation reduces the net flow of electrons to the electrode surface, then the magnetic insulation increases the voltage gradient which a given gap may sustain.

Since an average charged particle gyroradius radius which exceeds the local surface roughness by a large enough factor to allow the electrons, ions, or clumps to pick up more energy without striking a surface imperfection impairs the effectiveness of the magnetic insulation, the most important factor in whether magnetic insulation is a practical potential improvement to electrostatic accelerators is the birth energy of the spontaneously emitted electrons or other particles.

In the case of spontaneous field emission, whether of electrons, ions, or clumps, the birth energy at the electrode surface is very low, about the temperature of the material for electrons, and probably less for heavier particles, and thus spontaneous vacuum gap breakdown appears to be the phenomenon which may be most susceptible to amelioration by the application of magnetic insulation. This phenomenon occurs in electrostatic accelerators and their support structures when they are being vacuum conditioned without ion beams and also when they are being operated with ion beams, and, more generally, occurs for sufficiently high voltages between any pair of electrodes used for any application.

Additional sources of electron emission from accelerator electrodes that may induce high voltage breakdowns when charged particle beams are being accelerated include secondary electron emission due to interception of the accelerator electrodes by beam ions, beam electrons, or energetic neutrals produced by neutralization of beam ions due to collisions with gas molecules, and photoelectric electrons produced by ultraviolet light arising from collisional excitation of the beam or background gas. These phenomena are likely to result in electrons leaving the electrode surface with an average energy which is appreciably larger than in the case of the spontaneous field emission electrons or other particles, but the initial current density of electrons arising from these processes is likely to be much lower than in the case of spontaneous field emission, so they may still be somewhat ameliorated by magnetic insulation, and, in any event, they are probably less significant than spontaneous field emission as a source of breakdown.

Figure 2:
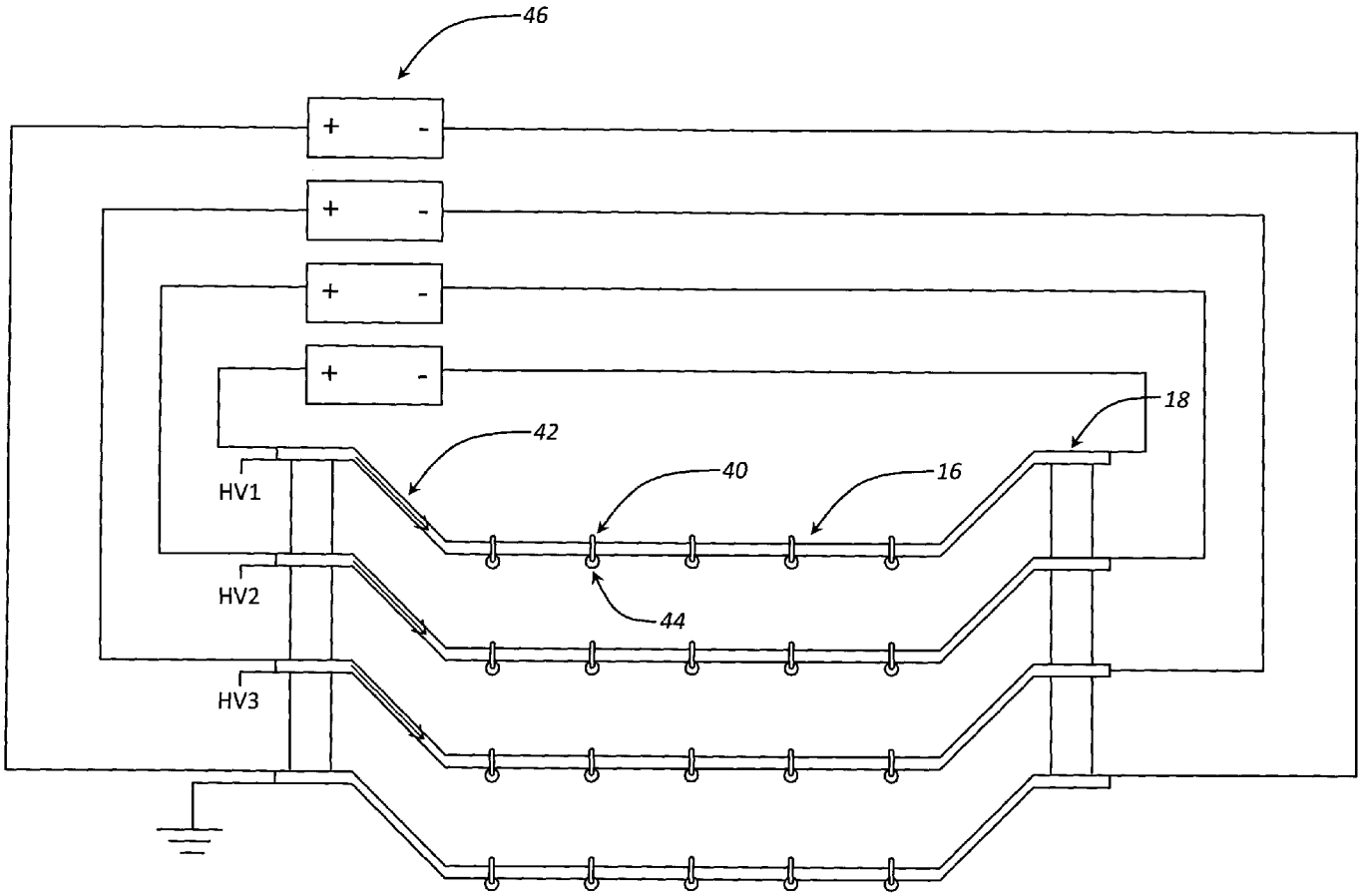
FIG. 2 is a schematic diagram illustrating one exemplary embodiment of the magnetic insulation concept of the present invention, whereby a current is run through and generates a parallel magnetic field around an accelerator electrode and associated support structure in order to prevent very low energy electrons from leaving the surface of the accelerator electrode and subsequently picking up energy from the surrounding electric field.
Figure 3:
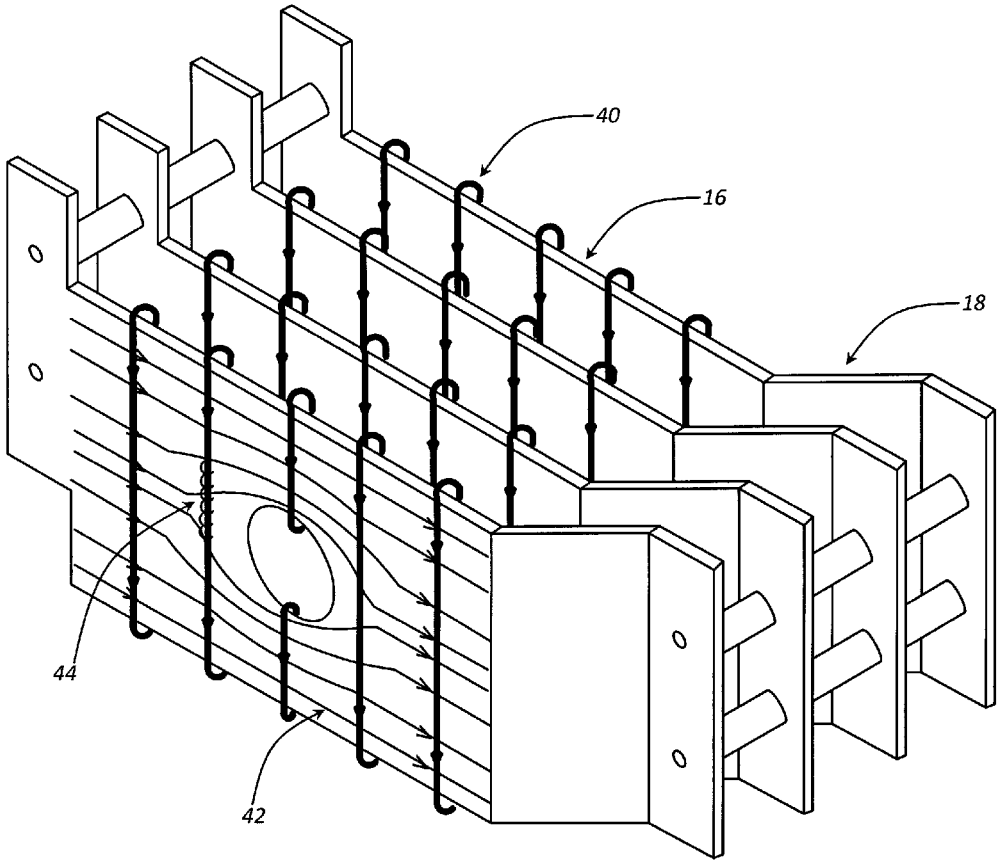
FIG. 3 is a perspective diagram illustrating the same exemplary embodiment of the magnetic insulation concept of the present invention, whereby a current is run through and generates a parallel magnetic field around an accelerator electrode and associated support structure in order to prevent very low energy electrons from leaving the surface of the accelerator electrode and subsequently picking up energy from the surrounding electric field.

Given the above theoretical discussion, referring to FIGS. 2 and 3, in one exemplary embodiment, the magnetic insulation systems and methods of the present invention involve encapsulating each of the accelerator electrodes 16 and associated support structures 18 with a magnetic field 40 formed by an electric current 42 flowing along the support structure 18 from one side of the flat grid plate 16, through the flat grid plate 16 and out the other side of the support structure 18, thus forming a magnetic field 40 that is everywhere parallel to the flat grid plate 16 and its support structure 18, perpendicular to the electric current 42. The magnetic field 40 is adjusted to be strong enough to bend electrons 44 born at the surface of the flat grid plate 16 back into the flat grid plate 16 before they travel far enough to pick up appreciable energy (for the most ubiquitous type of breakdown, the electrons have a birth energy of roughly the grid temperature). These electrons 44 are induce to spiral about the magnetic field 40, thereby being trapped at the surfaces of the accelerator electrodes 16. Preferably, each flat grid plate 16 has its own magnetizing current 42 fed from a power supply 46 (FIG. 2) at the grid potential. Preferably, the power supply 46 has a large current capability, but very little output voltage capability (i.e. a volt or so). Depending upon the particular electrostatic accelerator design, the magnetic fields 40 may be chosen to either be in the same direction around successive flat grid plate 16, or in opposite directions.

Experimental Procedure

Because the most important factor determining the required magnetic field strength to improve voltage holding is the birth energy of the charged particles and their interactions with the local micro-landscape of the electrode, the feasibility of magnetic insulation lends itself much more naturally to an experimental test than it does to a theoretical simulation. The following experimental program may be used to test whether magnetic insulation improves voltage holding in electrostatic accelerators.

The simplest breakdown phenomenon on which to test magnetic insulation is also the most ubiquitous, spontaneous breakdown. The facility required to test this is simply a vacuum enclosure containing two smooth rectangular electrodes separated by an adjustable gap across which high voltage may be applied. In order to simplify the experimental logistics, the grounding of the high voltage supply should be arranged such that the cathode electrode, from which field emission of electrons originates, is at ground potential. This allows the low voltage high current supply that produces the magnetic insulation to sit at ground potential, rather than needing to be floated at high voltage. The leads for the magnetic insulation current should approach the ends of the electrode at cathode potential from behind, so as not to distort the magnetic field (in an actual electrostatic accelerator, they connect to the support structure for each accelerator grid). The width of the electrodes are sized to match the available power supply, so that a surface magnetic field in the range of at least several hundred gauss to a kilogauss may be produced, and the length of the electrode should be at least as great as the width so that there is a planar region to the electric field. It is difficult to make an estimate of how large a magnetic field should be applied, but, from a practical point of view, it is unlikely that magnetic insulation finds much application if the required surface field is very large, say significantly larger than a few kilogauss. Since the birth energy of a field emission electron at the surface of an electrode is presumably about the temperature of the material, 0.025 eV, a relatively modest magnetic field may impede its motion. For instance, a 100 gauss field would restrict such an electron to a gyroradius of $3.8\times10^{-3}$ cm. Such a gyroradius might still allow an electron that escaped the surface to pick up some energy in a sufficiently high electric field, such as the $4\times10^{4}$ volts/cm in the highest field gap of some electrostatic accelerators. However, since the magnetic field is also present within the electrode, where the applied electric field is nil, it may impede electron motion sufficiently to reduce field emission. If needed, it is practical make the surface magnetic field significantly higher than 100 gauss.

The experiment then consists of finding the maximum voltage that a vacuum gap may sustain without the magnetic field, and then measuring how much, if any, this is increased as a function of the magnetic field produced by various current levels flowing through the electrode at cathode potential. If the magnetic field is beneficial at a small gap of a few tenths of a centimeter, then the gap may be gradually increased to distances greater than a centimeter, up to the limits of the high voltage supply.

If magnetic insulation proves useful in suppressing spontaneous breakdown, then, with some additions to the test facility, it may be tested for efficacy against other types of breakdown initiation. Adding an ultraviolet light source would test whether it suppressed photoelectric-induced breakdown, and adding very low current electron and ion beams would test whether magnetic insulation also suppressed breakdowns induced by secondary emission arising from grid interception of energetic particles. Magnetic insulation may be less likely to prove effective at inhibiting these types of breakdown mechanisms than in the case of electron field emission, simply because the birth energy of the electrons is much greater, especially in the case of secondary electron emission. However, since the current densities of ions, neutrals, and electrons striking electrode surfaces are typically orders of magnitude less intense than those arising from field emission, magnetic insulation may prove useful even if it does not suppress these additional sources of breakdown, so long as it has some effect upon electron-emission-initiated breakdown.

A different sort of breakdown which occurs in electrostatic accelerators is breakdown along insulators due to spontaneously emitted electrons from the electrodes striking insulators and releasing gas which leads to flashovers along the insulators. Such flashovers may also arise from charge buildup on the insulators, a phenomenon which is traditionally ameliorated by increasing the electrical conductivity of the insulator. While magnetic insulation may have little effect upon the second of these phenomena, surface charging, it may ameliorate the first one, gas emission, by suppressing spontaneous electron emission from the electrodes that form the support structure at the insulators.

Magnetic insulation may find use in electrostatic accelerators used for many applications—most immediately in the next generation of high energy high current negative hydrogen isotope accelerators planned for such nuclear fusion devices as ITER in the European Union and JT-60SA in Japan. The magnetic insulation fields will, of course, have the undesirable side effect of deflecting the ion beams being accelerated. However, this is a tolerable effect, in part because the energetic ions are much less effected by the magnetic field than are the very low energy electrons it is intended to suppress, but also because the magnetic field envelopes each electrode, so that it deflects the ions in one direction on the upstream side of the electrode (where upstream refers to the direction from which the beam is coming), and in the opposite direction on the downstream side, so that the net deflection is primarily due just to the fact that the ion velocity is higher on the downstream side of the electrode than on the upstream side. If there are multiple stages of grids using magnetic insulation, then the total net deflection of the ion beam may be designed to be as low as desired if the currents in different stages are chosen to run in different directions. Since the magnetic fields exert mechanical forces (either repulsive or attractive, depending upon the relative directions of current flow in successive grids) on the grids and their support structures, these forces must be accounted for in the design, and may impose practical constraints upon the maximum strength of the magnetic insulation, Thus, the present invention provides systems and methods using electrical currents flowing along accelerator grids or electrodes and their support structures to produce enveloping magnetic fields to suppress high voltage breakdowns in vacuum. In order to be useful, this technique does not need to work perfectly. In many applications, such as the large area high current accelerators used in nuclear fusion experiments, where several hundred to more than a thousand beamlets of ions are accelerated through successive stages of grids, improving the voltage that a single accelerator gap or series of gaps may sustain without breakdown by even twenty percent or so is considered significant, as is a substantial reduction in the time required for high voltage conditioning. In any event, magnetic insulation is a relatively easy idea to test, and its success or failure lends itself to simple interpretation.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

I claim:

1. A system for accelerating charged entities, comprising:

a charged entity source where said charged entity source is capable of generating a stream of charged particles;

a plurality of accelerator electrodes for accelerating said charged particles provided by the charged entity source where said accelerator electrodes are flat grid plates each having an aperture within said plate and where said plates are arranged in an orientation such that the grid plates are positioned parallel to each other and where said apertures are coincidental to allow the stream of charged particles to flow from one to the next;

support members to which said plates are attached; and one or more power supplies coupled to the accelerator electrodes for providing an electrical current through each of the accelerator electrodes and generating a magnetic field around each of the grid plates.

2. The system of claim 1, wherein the one or more power supplies are also coupled to support members for providing an electrical current through each of the support members and generating a magnetic field around each of the support members.

3. The system of claim 2, wherein a direction of the current provided through each of the accelerator electrodes and support members is reversed for alternating accelerator electrodes and support members.

4. The system of claim 2, wherein the magnetic field is substantially parallel to a surface of each of the grid plates and support members.

5. The system of claim 4, wherein the magnetic field prevents charged entities from leaving a surface of each of the accelerator electrodes and support members and picking up energy from a surrounding electric field.

6. The system of claim 1, wherein the one or more power supplies, electrical currents, and magnetic fields are used to improve the voltage holding capability of the system.

* * * * *